United States Patent [19]

McClintock

[11] Patent Number: 4,588,027

[45] Date of Patent: May 13, 1986

[54] FINNED OR SERRATED ROD BAFFLES FOR FINNED TUBE-SHELL HEAT EXCHANGER

[75] Inventor: William A. McClintock, Bartlesville, Okla.

[73] Assignee: Phillips Petroleum Company, Bartlesville, Okla.

[21] Appl. No.: 348,378

[22] Filed: Feb. 12, 1982

[51] Int. Cl.[4] ..... F28F 9/00; F28F 9/24

[52] U.S. Cl. ..... 165/159; 165/162; 165/172

[58] Field of Search ..... 165/67, 76, 159, 162, 165/172, 178, 109, 69; 248/68.1

[56] References Cited

U.S. PATENT DOCUMENTS

| | | | |
|---|---|---|---|
| 2,402,209 | 6/1946 | Ryder | 165/162 |
| 3,012,761 | 12/1961 | Gardner et al. | 165/69 |
| 3,163,208 | 12/1964 | Cuzzone et al. | 165/162 |
| 3,545,537 | 12/1970 | Hill, Jr. | 165/162 |
| 3,708,142 | 1/1973 | Small | 165/162 |
| 3,998,268 | 12/1976 | Sagan | 165/162 |
| 4,095,648 | 6/1978 | Shipes | 248/68.1 |
| 4,098,332 | 7/1978 | Bratthall et al. | 248/68.1 |
| 4,127,165 | 11/1978 | Small | 165/162 |
| 4,136,736 | 1/1979 | Small | 165/162 |
| 4,286,366 | 9/1981 | Vinyard | 165/162 |
| 4,342,360 | 8/1982 | Gentry et al. | 165/162 |

*Primary Examiner*—Albert W. Davis, Jr.
*Assistant Examiner*—John K. Ford
*Attorney, Agent, or Firm*—John R. Casperson

[57] ABSTRACT

In a tube-shell heat exchanger containing finned tubes, the support rod baffle contains rods having longitudinal fins and a serrated cross-section, which provide more positive contact with the finned tubes than conventional smooth rods.

9 Claims, 12 Drawing Figures

FINNED OR SERRATED ROD BAFFLES FOR FINNED TUBE-SHELL HEAT EXCHANGER

BACKGROUND OF THE INVENTION

Various rod baffled heat exchangers have been disclosed in the art. See, e.g., U.S. Pat. No. 4,136,736, which is hereby incorporated by reference. Several of these heat exchangers have been put into successful practical application. One of the continuing problems in such heat exchangers is to establish firm contact between the rods and the heat exchanger tubes. For example, one proposal to solve this problem was to provide rods with areas of varying cross section, sliding the rods between the tubes so that areas of each rod having small cross sections are replaced by areas of the rods having a larger cross section between the tubes. Thus, the area of the rod with larger cross section makes firm contact with the tubes. In this design rods are employed which have a special shape with alternating sections of smaller and larger cross sections. The rods also have to be longer than necessary for the heat exchanger in order to make possible the sliding movement.

It is one object of this invention to provide a rod baffle useful for heat exchangers with improved rods allowing firm contact and efficient heat transfer between the rods and the tubes.

Another object of this invention is to support tubes of a tube bundle in a manner which protects them from failure due to vibration.

Still another object of this invention is to provide a tube support to substantially reduce tube failure in a tube bundle and at the same time improve heat transfer efficiency.

Another object of this invention is to provide a heat exchanger incorporating such rod baffles.

A further object of this invention is to provide a process to produce such heat exchangers.

BRIEF DESCRIPTION OF THE DRAWINGS

These and other objects, advantages, details, features, and embodiments of this invention will become apparent to those skilled in the art from the following detailed description of the invention, the appended claims and the drawing in which:

SUMMARY OF THE INVENTION

Figure 1:
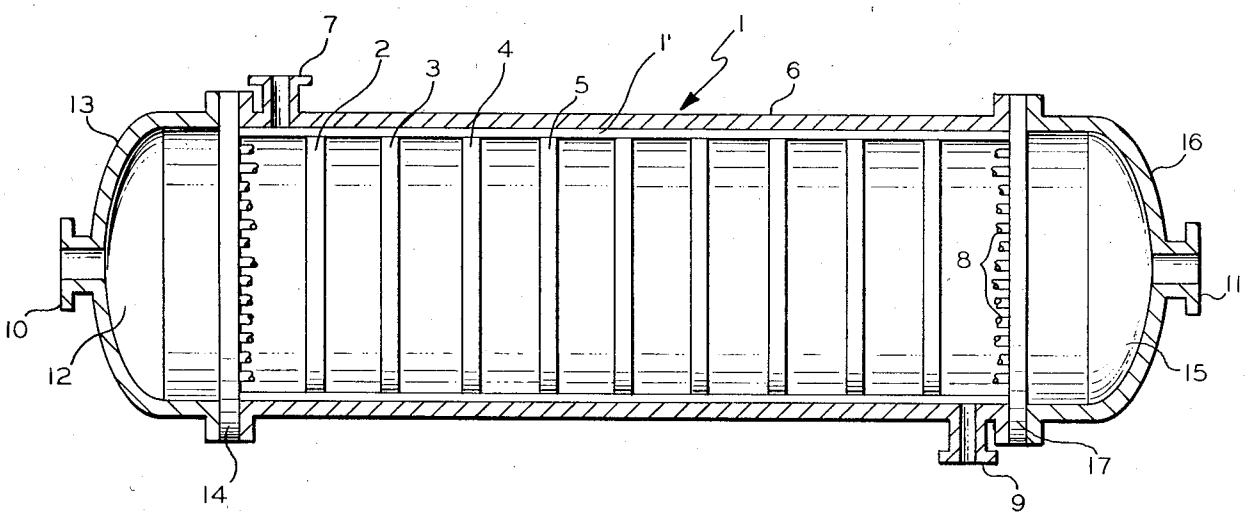
FIG. 1 is a view of a tube and shell heat exchanger showing the shell in cross-sectional view.
Figure 2:
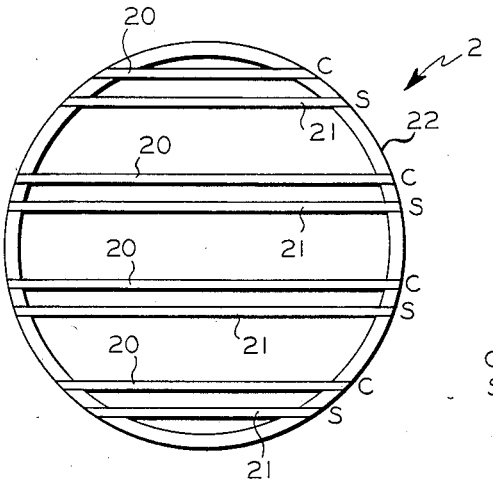
FIGS. 2, 3, 4 and 5 are views of four serrated rod baffles which together establish radial support of every tube in the heat exchanger.
Figure 3:
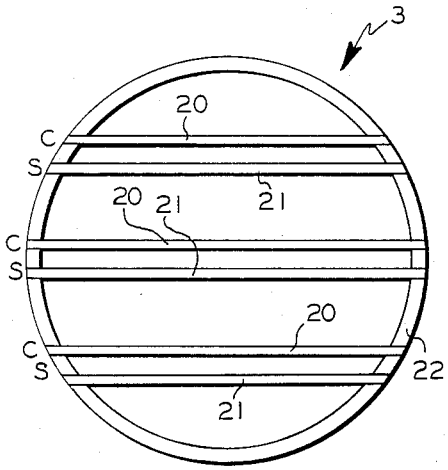
Figure 4:
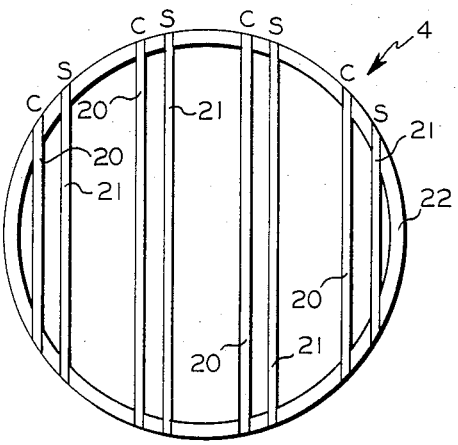
Figure 5:
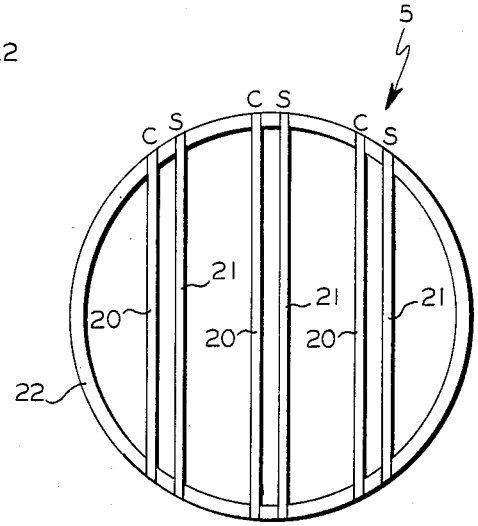

In accordance with this invention a longitudinally-finned rod baffle is provided wherein the serrated cross sections of the rods allow the firm engagement of such rods with, e.g., finned heat exchanger tubes, by the simple insertion of such rods between rows of such tubes.

In accordance with a first embodiment of this invention a rod baffle is provided which comprises a plurality of parallel rods. At least some of these rods have longitudinal serrations or longitudinal fins in at least some areas along the rod, around at least part of the circumference of said rod.

The longitudinal fins are applied or worked in the rods in such a manner that the rods have a cross section of a serrated or corrugated circle, with the serrations providing a plurality of changes in the rods' surface, around the circumference of the rod, from concave to convex. In other words, the longitudinal fins, viewed in cross section, are projections, protrusions or protruberances above the circular circumference surface of the rods.

The fins or serrations are applied or worked in said rods, which can be solid or hollow, in such a manner that the distance between parallel tangent planes being parallel to the rod axes and touching the peaks of said longitudinal serrations is only slightly less than the average distance between the bases of the radial fins on tubes in adjacent rows, or "free" space. Thus, the serrated rods are readily inserted or forced between the tube rows of a heat exchanger in such a manner that the rod serrations interlock with the radial tube fins and/or bend or deflect them aside, creating tension and compression forces which support the tubes in place and tend to prevent their vibration.

Alternatively, the serrated rods can be partially serrated, so that the distance between parallel tangent planes being parallel to the rod axis and touching the rod surface varies from a smallest dimension to a largest dimension around the rod. That is, two segments of the circumference of the rod, covering from about 80 to 110 degrees each of said circumference, and separated by smooth portions, are serrated. These serrated segments are most preferably located on opposite sides of the rod circumference. The so-shaped rods are readily inserted between tube rows of a heat exchanger with the largest or finned or serrated dimension arranged parallel to the tube axes and the smallest or non-finned or non-serrated dimension arranged orthogonally to the tube axes. Then, rotating the rods about their axes engages the finned or serrated portions of the rod in firm contact with the tubes. The rods, therefore, are arranged for rotation in the baffle and after their installation are fixed in the baffle against any unplanned rotation or other movement. Preferably, the finned or serrated dimension of the serrated circular cross-section of the rods is equal to or less than the average "free" space or distance between adjacent finned tubes, i.e. between the bases of the fins of adjacent tubes, and simultaneously greater than the distance between the tips of the fins of said adjacent tubes. Measurements between fin surfaces refer to the undisturbed or unbent fins, prior to insertion or rotation of rods.

Not all of the rods of the rod baffle must be of serrated circular cross-section. It is preferred that rods of circular cross-section and rods of serrated cross-section alternate in the rod baffle. It is, however, within the scope of this invention that all the rods are of the serrated cross-section structure. To provide optimum stiffness for a given diameter of rod and the amount of metal used, some or all of said rods can be hollow or pipe-shaped.

The rod baffle further comprises a baffle support to which the rods are attached. This baffle support prior to the installation of the rod baffle can allow the rotation of the rods having the serrated circular cross-section. After the final installation of the rod baffle at least some of the serrated-circular cross-section rods are fixedly attached to the baffle support to prevent any rotation of the rods so attached in the baffle.

The smallest and the largest dimensions of the cross-section of the serrated rods are related to the free distance between the tube rows or respectively between the fin surfaces. The term "fin surface" is intended to describe an imaginary surface or cylinder tightly surrounding all the fin edges of the tubes. The smallest dimension of the serrated rod cross-section can be smaller than the free distance between the tube rows or the fin surfaces. The largest dimension of the serrated cross-section of the rod is at least equal to, and preferably larger than, the free distance between fin surfaces described. This free distance in the case of a square pitch of tubes is equal to the difference between the axial distance of adjacent tubes and the diameter of one tube; this diameter can refer to either the tube diameter or the outside diameter of the fins.

In the embodiment permitting the rotation of serrated rods to engage the fins of the heat exchanger tubes, at least one end of the rods of serrated cross-section can be provided with means for applying a torque around their axes to the rods. This torque will rotate the rods into contact, e.g., with the heat exchanger tubes. One such means could be a polygonally shaped recess in the end of the rod. Another possibility would be to form the end of the rod in a polygonal shape such as a hexagon so that cranks or wrenches can be used to turn these rods. Preferably the rods can be provided with such means for rotation at both ends of said rods.

The baffle also comprises fixing means to securely hold the rods of serrated circular cross-section in position after the installation. The fixing means can, for instance, be spot-welds.

A second embodiment of this invention is a heat exchanger. This heat exchanger comprises a plurality of parallel finned tubes which are arranged in a plurality of parallel rows. At least one rod baffle comprising a plurality of parallel rods arranged between adjacent tube rows with each rod contacting the tubes of at least one row is provided for. This rod baffle contains rods with at least partially serrated circular cross-section which have been inserted or rotated into contact with the finned tubes of the tube row. These rods are as defined in more detail above in connection with the rod baffle.

The rod baffle preferably comprises a rod support surrounding the plurality of parallel finned tubes in which the serrated cross-section rods could be inserted, or rotated around the rod axes into firm engagement with the tubes prior to the installation, and to which the rods have been rigidly attached after such insertion or rotation. Said rod support means can be a simple ring surrounding the tube bundle.

In order to provide optimum mechanical and flow properties of the heat exchanger it is presently preferred to have a plurality of rod baffles meshing with the tube rows. Most preferably there is at least one set of rod baffles providing radial support for the tubes. To provide radial support for a tube requires at least three non-parallel rods (non-parallel with respect to the tubes). Typically, in a square pitch arrangement of the tubes four rods provide the radial support for one tube. Each rod provides support for a plurality of tubes. By "radial support" an arrangement is meant wherein three or more non-parallel rods contact a tube so that this tube cannot be moved in any radial direction. The radial support prevents excessive movement or variation of the tube of the heat exchanger and is, therefore, desirable.

The rods of the rod baffle are arranged non-parallel and at a substantial angle to the tube longitudinal axis. For simplicity of design and construction it is often preferred that the rods are arranged at 90° or less with respect to the tube. Individual rod baffles providing radial support for tubes in a square pitch of the tube arrangement have their rods often arranged at 90° with respect to the rods of the other baffle. In the case of a triangular pitch of the tubes the rods from one baffle are arranged at, e.g., 60° with respect to the rods of another baffle.

Figure 9:
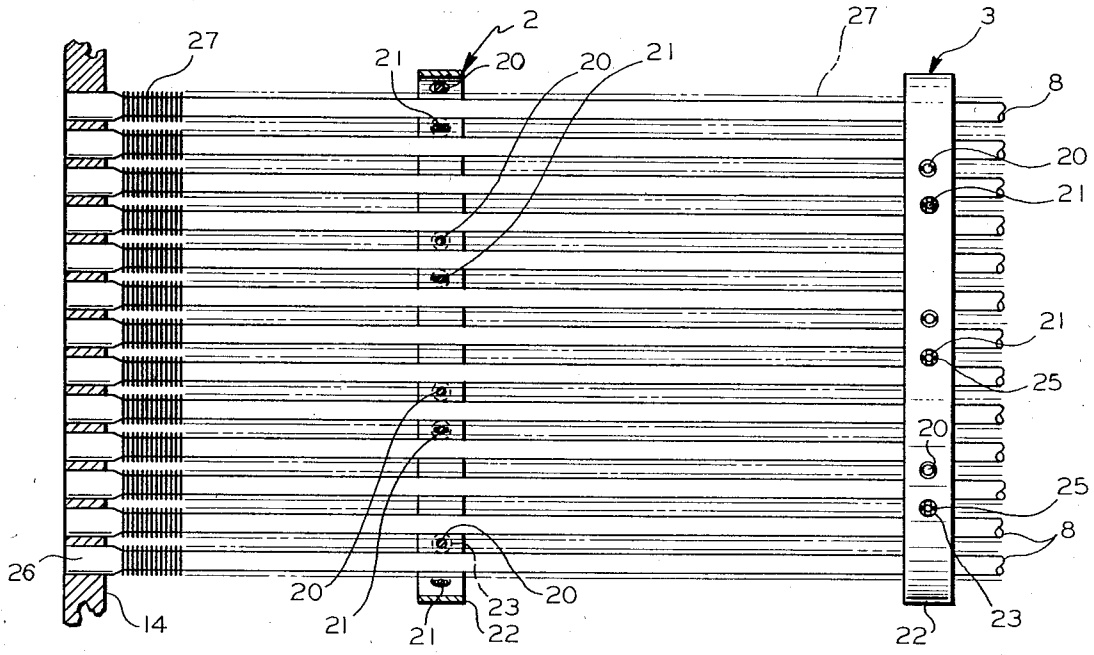
FIG. 9 shows an enlarged sectional view illustrating the shape and position of the serrated rods prior to and after the final installation.

Although the baffles are normally arranged in the tube bundle so that they all have the same baffle angle, as shown in FIGS. 1 and 9, it is within the scope of the invention, however, to employ two or more baffles having different baffle angles and/or slanting in any number of direction. See, e.g., U.S. Pat. No. 4,127,165, FIG. 1.

In some applications the tubes of the heat exchanger can be provided with end sections having a diameter larger than the diameter of the middle part of the tubes. Furthermore, it is particularly preferred for the present invention that the tubes of the heat exchanger are provided with fins. These fins can be of a variety of shapes and designs, e.g., ring-shaped disks spaced along the tube axis, or fins helically arranged along the tube. In each instance the rods of serrated cross-section are inserted or rotated into engagement with the fins to exert their stabilizing pressure on these fins. For ease of assembly it is presently preferred that the distance between adjacent fin surfaces, measured in radial direction from the individual tubes, is substantially smaller than the largest dimension of the serrated cross-section of the rod. Thus, it is made certain that the serrated rods, when rotated into contact with the fins on the tubes, will always find a plurality of fins upon which the stabilizing pressure is exerted. For instance, the radial distance between fin surfaces of adjacent tube fin sections can be about half the length of the largest dimension of the serrated rods. A typical "fin density" on the tubes can be 10 to 35 fins per inch, an example being 19 fins per inch. In such an example of finned tubes having base diameters (without fins) of about 0.625 inches and spaced about 1 inch between longitudinal axes, radial fins of about 0.025 inches thickness and about 0.05 inch height could be spaced about 0.029 inch apart. The longitudinal fins or serrations on a rod having a base diameter of about 0.25 inch to support such tubes could then be about 0.05 inch in height and 0.02 inch thick, spaced around at least part of the rod about 0.03 inch apart. The height of such longitudinal fins can be from about 10% to 60% of the diameter of the solid portion of the rods.

Although fins and serrations of many different cross-sections can be used in this invention, preferably the serrations on the supporting rods are chosen to mesh or engage most effectively with the fins of the heat exchanger tubes. Most preferably, serrations of triangular cross-section can be provided, so that upon insertion or rotation of said rods between adjacent tubes, the serrations will wedge firmly between adjacent fins. It is preferred that the longitudinal serrations on the rods be strong enough to deform the tube fins on insertion or rotation of the rods between the tubes, since the fins of adjacent tubes will generally not be in exact alignment with each other.

It is not necessary but presently preferred that the rods are arranged in groups in which rods with circular cross-section alternate with rods with serrated cross-section in the series of open spaces between the tube rows. Advantageously, such a group of alternating circular and serrated cross-section rods is subdivided into a first and a second subgroup. The rods of each of these subgroups are parallel and arranged essentially in one plane. The plane of the first subgroup and the plane of the second subgroup are axially displaced with respect to each other along the tube axis. In the case of a square pitch of the tubes it is preferred to have two groups, each subdivided into the two subgroups described, arranged so that the rods of one group are at 90° with respect to the rods of the other group and so that the rods of the two groups provide radial support for each tube. The arrangement of the rods in the subgroups may be such that in each subgroup two rods and two empty spaces between tube rows alternate. It is, however, also within the scope of this invention that one rod and one empty space alternate in each of the subgroups.

The tubes in the tube and shell heat exchanger of this invention may be individual tube sections that are attached at both ends to a tube sheet or these tubes may be hairpin type tubes which are bent and attached at both ends to the same tube sheet. The shape and function of the serrated rods in both instances remains essentially unchanged. It is appreciated by those skilled in the art that heat exchangers in accordance with the invention can be designed incorporating a variety of the configurations shown in the art such as U-tubes, multiple tube passes, floating head designs, etc.

In accordance with a third embodiment of this invention a process for manufacturing a tube bundle useful in a tube and shell heat exchanger is provided for. This process comprises insertion of a rod of serrated cross-section between two parallel rows of the tube. The rod of serrated cross-section is as defined above. The rod is inserted between two parallel rows of finned tubes so that the largest cross-sectional dimension extends essentially orthogonally to the direction of the tubes' longitudinal axis, and the longitudinal serrations make firm contact between the tube fins.

Alternatively, a rod of partially-serrated cross-section is easily slipped in between adjacent tube rows with its narrowest dimension orthogonal to the tube axis. Then the rod is rotated around its axis and into firm engagement with the fins of at least one of the tube rows. Finally the rod of serrated cross-section is fixedly attached at its ends to a rod support means to prevent any further rotation of this rod. The above-described preferred geometrical and structural embodiments of the heat exchanger are also preferred in the application of the process of this invention.

Since one of the more important aspects of the invention is the reduction of tube failure due to vibration, it will be apparent to persons skilled in the art that the maximum unsupported tube distance is important in designing a supporting apparatus. It is important to prevent tube collisions by adjacent tubes between support points and to prevent tube failure due to vibration fatigue; this the supporting apparatus is generally designed so that the maximum allowable tube deflection under load is equal to something less than one-half the clearance between adjacent tubes and the bending stress under conditions of vibration is within acceptable fatigue limits for the tube material used. Determination of acceptable fatigue limits for the tube material used is well known to those skilled in the art.

DETAILED DESCRIPTION OF THE PREFERRED EMBODIMENTS

The following detailed description of the drawing is intended to show further preferred features of this invention without undue limitation of its scope.

FIG. 1 shows partially in cross-section a tube and shell heat exchanger. A rod baffled tube bundle 1 is surrounded by shell 6. The tubes 8 in the tube bundle 1 are supported by a plurality of rod baffles 2, 3, 4, 5 with slide bars 1'. One fluid enters the shell side of the tube and shell heat exchanger through an inlet 7 and after heat exchange with the fluid in the tubes 8 (FIG. 6) leaves the shell side via exit 9. The fluid flowing through the tubes 8 enters the heat exchanger via inlet 10 and leaves the heat exchanger via outlet 11. This fluid flows from chamber 12 which is defined by the end section 13 of the heat exchanger and the tube sheet 14 through the tubes 8 and into the other end chamber 15 which is similarly confined by the end section 16 and the other tube sheet 17.

Figure 6:
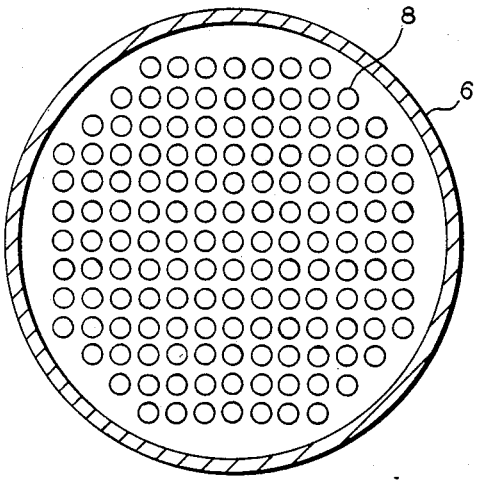
FIG. 6 is a schematic cross-sectional view showing a tube arrangement in a square pitch of a heat exchanger.

The tubes 8 as shown in FIG. 6 can be arranged in a square pattern. The tubes 8 are kept in position by a plurality of rod baffles 2, 3, 4, 5, etc. These rod baffles, as shown in more detail in FIGS. 2–5, each comprise a plurality of circular rods 20 and rods of serrated cross-section 21. To illustrate this further the letters "C" and "S" have been written next to the individual rods to indicate their cross-sectional shape, "C" being cylindrical, "S" being serrated. In each "adjacent" pair of rods, one can be finned or serrated, at least in part, and one circular without fins, or both adjacent rods can be finned or serrated, at least in part. These rods are rigidly attached, e.g., by spot welding (see FIGS. 11 and 12), to a ring 22. The rods of the baffles 2 and 3 are parallel and the rods of baffles 4 and 5 are parallel. Baffles 2 and 3 are axially spaced and so are baffles 4 and 5, as seen in FIG. 1. The rods of baffles 2 and 3 are arranged at 90° with respect to the rods of baffles 4 and 5.

Figure 7:
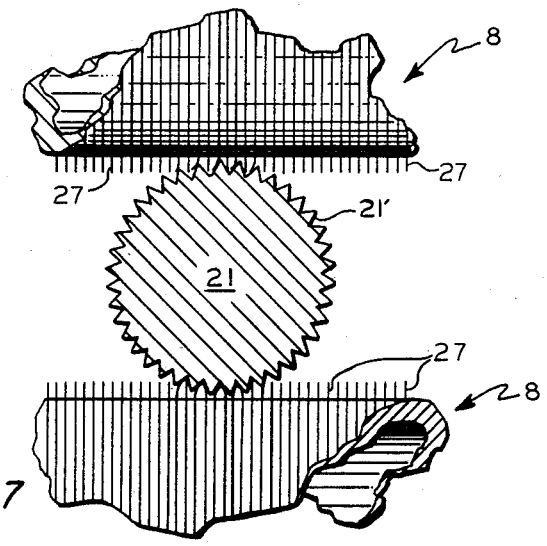
FIG. 7 shows a cross-sectional view of a serrated rod in operating position, deflecting the fins on the adjacent finned tubes.
Figure 8:
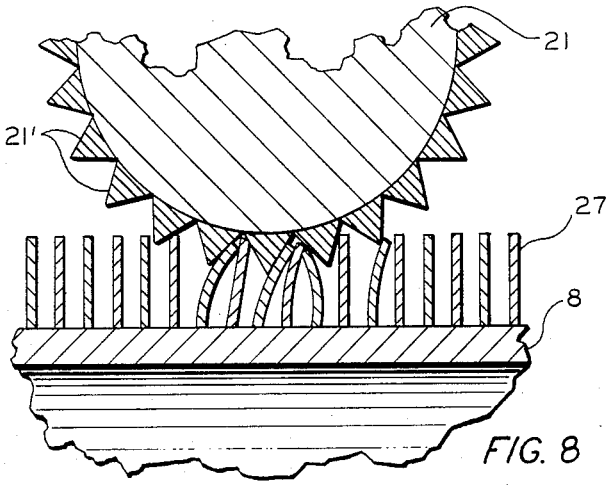
FIG. 8 is an enlarged cross-sectional view of the rod and tube of FIG. 7.

FIGS. 7 and 8 show the serrated rod 21 inserted between finned tubes 8 so that the longitudinal serrations 21' of the rod engage the fins 27 of the tubes by bending, deflecting or deforming said fins. If a partially serrated rod is inserted with its narrow dimension perpendicular to the tube axes, then rotated to place the largest dimension perpendicular to said tube axes and engage the serrations and tube fins, said rod can be rotated a few degrees in the opposite direction to straighten deformed fins and more firmly engage said serrations and fins.

Figure 10:
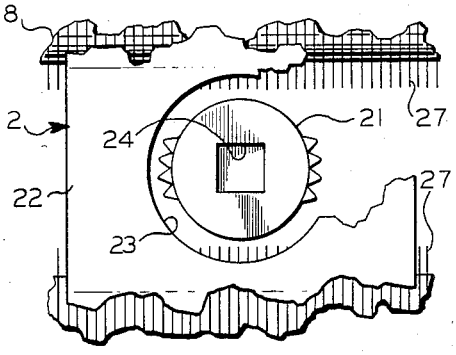
FIG. 10 shows an embodiment of a rod of partially-serrated cross-section.
Figure 11:
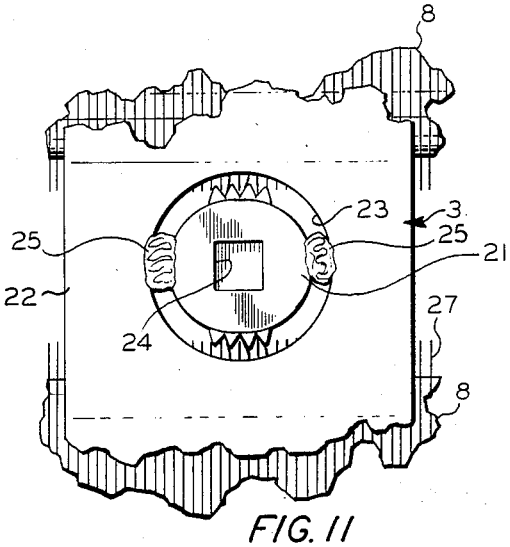
FIG. 11 shows a longitudinally finned rod passing through the ring of the rod baffle and can be spot-welded to the ring.
Figure 12:
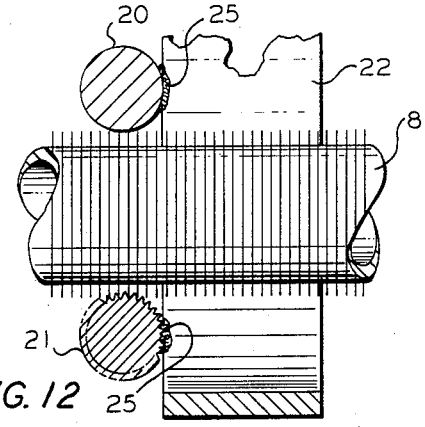
FIG. 12 shows an embodiment of spot-welding of the serrated rods to the rim of a ring baffle.

The invention is a partial side view in FIG. 9. In this figure the baffle 2 is shown in the position prior to the rotation of the partially-serrated rods 21 and baffle 3 is shown in a position after the rotation of the partially-serrated rods 21 into firm contact with the tubes 8. The rods 20 and 21 are shown in the drawing with the support ring 22. In baffle 2 the rods 21 are shown as inserted between the tubes 8. Ring 22 is provided with a circular opening 23 to allow turning of the rod 21 having an essentially eccentric, partially serrated cross-section. Prior to the turning of the partially serrated rods 21 there is a gap between the tubes and the rods. After the rods 21 with serrated cross-section have been turned into firm contact with the tubes, at least some of the rod serrations engage firmly with the fins of the adjacent tube rows. This is shown in FIGS. 7 and 8. The rods in baffle 2 of FIG. 9 are shown in cross-section view whereas the rods in baffle 3 of FIG. 9 are shown in end view. The ends of the rods 21 are provided with a square to rectangular recessed area 24 in which a tool can be inserted for rotating these rods. Such rods can also be provided with a polygonally shaped end section for rotation by a wrench. In FIG. 12 there is schematically shown the spot welding connection 25 between the rods 20 and 21 and the face of ring 22. Rods 20 as in FIG. 9 also pass through holes, not numbered, in rod support rings 22, and are welded to rings 22, as illustrated for rods 21. In FIG. 11 there is schematically shown the spot welding 25 of a rod 21 in its final supporting position. In FIG. 10 there is schematically shown a rod 21 in its position prior to rotating rod 21 at about 90 degrees.

The tubes 8 have a wider end section 26 at tube sheet 14 (and 17, not shown in FIG. 9). The tubes are also provided with fins 27 as shown in more detail in a partial cross-sectional view in FIG. 9. When the serrated rods 21 are turned 90° to wedge the tubes 8, contacting their fins 27, a slight deformation of these fins by the wedging serrated cross-section rod 21 may occur, as shown in FIGS. 7 and 8.

The rod 21 with partially serrated cross-section is slipped through the hole 23, the diameter of which is at least as large as the maximum extension of the serrated cross-section. After the rotation of the rod with serrated cross-section, e.g., by 90°, and into contact with the fins of adjacent fin tubes, the ends of serrated rod 21 are spot or tack welded at 25 to the support rings 22.

Labeling the major dimension (M) and the minor dimension (m) of the eccentric cross-section of the partially-serrated cross-section rod 21, the tube dimensions can be related to the distance (A) between the axes of adjacent tubes and the "diameter" (D) of tube 8 (in this case the diameter of the fin surface) for the embodiment of a square pitch of the tubes as follows:

$$m<(A-D)$$

$$M>(A-D).$$

Additionally, $m<(A-D)$, where d represents the diameter of tube 8 proper, measured at the base of the fins.

FIGS. 7 and 8 show in cross-section, a serrated rod 21 with serrations 21' (shown fully serrated) positioned between two adjacent tubes 8 so that some of the fins 27 on each tube are deformed, so as to effect the desired contact and tube support with a minimum disruption of the fins 27 on tubes 8. These Figures show an operating position of rod 21 holding tubes 8. As previously disclosed, rods 21 can be serrated either completely or partially around the circumference.

In a typical heat exchanger the fin surface "diameter" D of finned tube 8 would be 0.726 inch. The outside diameter of the tube without fins is 0.625 inch. Each fin height (from the base or root) is thus 0.0505 inch. There are about 19 fins per lineal inch.

The distance A between adjacent tubes would typically be one inch. The plain end 26 diameter at tube sheet is $\frac{3}{4}$ inch; square pitch is used.

The plain rod 20 would have a diameter of about $\frac{1}{4}$ inch, and the partially-serrated rod 21 would have an effectively eccentric or elliptical cross-section, with the major axis M being about 5/16 inch and the minor axis m being $\frac{1}{4}$ inch.

The usual materials are employed for the construction of the rod baffle heat exchanger such as stainless steel for the tubes and rods. Finned tubes such as described are commercially available under the trademark "Wolverine S/T type fin tubes".

Although FIG. 7 shows openings 23 in rod support means 22 for the rods 21, and shows openings (not numbered) in rod support means 22 for rods 20, it is pointed out that rods 20 and 21, at their respective ends, after being properly positioned in the tube bundle, can be welded (25) to a radial surface of means 22. A radial surface of means 22 is a surface of means 22 lying in an imaginary plane which is substantially perpendicular to the longitudinal axes of tubes 8.

Reasonable variations and modifications which will become apparent to those skilled in the art can be made in this invention without departing from the spirit and scope thereof.

I claim:

1. A heat exchanger comprising (a) a plurality of parallel tubes having circumferential fins thereon, said tubes being arranged in a plurality of parallel rows to form a bundle of parallel tubes, and (b) at least one rod baffle comprising a plurality of parallel rods attached to an outer ring surrounding the bundle of parallel tubes, said rods positioned between adjacent parallel rows of said tubes, at least some of the plurality of rods having longitudinally extending serrations engaging the circumferential fins of the tubes in the tube rows between which they pass.

2. A heat exchanger in accordance with claim 1 comprising a plurality of rod baffles.

3. A heat exchanger in accordance with claim 2 wherein at least one set of rod baffles provides radial support for the tubes.

4. A heat exchanger in accordance with claim 1 wherein said tubes are arranged in a square pitch and wherein at least four rod baffles are required to radially support the tubes and the rods of one rod baffle are arranged at an angle of about 90 degrees with respect to the rods of another rod baffle.

5. A heat exchanger in accordance with claim 4 wherein the tubes comprise end sections having a diameter larger than the diameter of the middle part.

6. A heat exchanger in accordance with claim 4 wherein the largest dimension of the serrated rods' cross-section is larger than the free distance between adjacent tube row fin surfaces, but smaller than the free distance between adjacent tube rows and the serrations interlock with the fins.

7. A heat exchanger in accordance with claim 1 wherein said rods with serrated circular cross-section when inserted between rows of tubes contact said fins, exerting stabilizing pressure on these fins.

8. A heat exchanger in accordance with claim 1 wherein the distance between adjacent tube fin surfaces, measured in a direction perpendicular to the individual tube axes, is substantially smaller than the largest radial dimension of said serrated cross-section of said serrated rod.

9. A heat exchanger in accordance with claim 1 wherein in each of said baffles two rods and two empty spaces between tube rows alternate.

* * * * *